US006541102B1

(12) United States Patent
Missell et al.

(10) Patent No.: US 6,541,102 B1
(45) **Date of Patent: *Apr. 1, 2003**

(54) INK JET RECORDING ELEMENT

(75) Inventors: Gregory E. Missell, Penfield, NY (US); Christine Suminski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/579,635

(22) Filed: May 26, 2000

(51) Int. Cl.[7] ..... B41M 5/00
(52) U.S. Cl. ..... 428/195
(58) Field of Search ..... 428/195, 532, 428/364, 361

(56) References Cited

U.S. PATENT DOCUMENTS

| | | | | | |
|---|---|---|---|---|---|
| 4,460,637 | A | * | 7/1984 | Miyamoto et al. | 347/105 |
| 4,954,395 | A | * | 9/1990 | Hasegawa et al. | |
| 5,522,968 | A | | 6/1996 | Kuroyama et al. | |
| 5,635,297 | A | | 6/1997 | Ogawa et al. | |

* cited by examiner

*Primary Examiner*—Pamela R. Schwartz
(74) *Attorney, Agent, or Firm*—Harold E. Cole

(57) ABSTRACT

An ink jet recording element comprising a resin-coated paper support having thereon an ink-retaining layer comprising voided cellulosic fibers in a polymeric binder, the ratio of the voided cellulosic fibers to the polymeric binder being from about 90:10 to about 50:50, the length of the voided cellulosic fibers being from about 10 $\mu$m to about 50 $\mu$m.

5 Claims, No Drawings

INK JET RECORDING ELEMENT

CROSS REFERENCE TO RELATED APPLICATION

Reference is made to commonly-assigned, copending U.S. patent applications:

Ser. No. 09/579,592, filed of even date herewith, of Missell et al., entitled "Ink Jet Printing Process" now U.S. Pat. No. 6,428,164;

Ser. No. 09/580,184, filed of even date herewith, of Missell et al., entitled "Ink Jet Recording Element"; and Ser. No. 09/579,591, filed of even date herewith, of Missell et al., entitled "Ink Jet Printing Process"now U.S. Pat. No. 6,428,163; the teachings of which are incorporated herein by reference.

FIELD OF THE INVENTION

This invention relates to an ink jet recording element, more particularly to an ink jet recording element which contains certain cellulosic fibers.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having thereon a base layer for absorbing fluid and an ink-receiving or image-forming layer. The recording element may be porous or non-porous.

Many porous ink jet receivers consist of organic or inorganic particles that form pores by the spacing between the particles. The ink and solvents are pulled into this structure by capillary forces. In order to have enough pore volume or capacity to absorb heavy ink lay downs, these coatings are usually coated to a dry thickness on the order of 40 $\mu$m to 60 $\mu$m, which can be costly because of the layer thickness.

U.S. Pat. Nos. 5,522,968 and 5,635,297 relate to ink jet receiver elements comprising a support containing cellulose or wood pulp. There is a problem with these elements, however, in that ink jet inks printed on them would tend to bleed through the paper causing paper cockle and low optical density. It is an object of this invention to provide an ink jet receiver element which has fast dry times, no paper cockle and high optical density.

SUMMARY OF THE INVENTION

This and other objects are provided by the present invention comprising an ink jet recording element comprising a resin-coated paper support having thereon an ink-retaining layer comprising voided cellulosic fibers in a polymeric binder, the ratio of the voided cellulosic fibers to the polymeric binder being from about 90:10 to about 50:50, the length of the voided cellulosic fibers being from about 10 $\mu$m to about 50 $\mu$m.

Using the invention, an ink jet receiver element is obtained which has fast dry times and high optical density.

DETAILED DESCRIPTION OF THE INVENTION

The voided cellulosic fibers used in the ink-retaining layer of the ink jet recording element of the invention have greatly increased porosity over organic or inorganic particles usually used in porous layers of many ink jet recording elements. In addition, these voided cellulosic fibers have an internal voided structure that allows them to act as "microstraws" to further assist in absorbing fluids. This voided cellulosic fiber structure provides very fast dry times with very heavy ink lay volumes. In addition, the images obtained using the voided cellulosic fiber layer also have high optical density.

Examples of voided cellulosic fibers which can be used in the invention include Arbocel® alpha cellulose fibers, manufactured by Rettenmaier of Germany. These cellulosic fibers are made of different woods such as beech, maple or pine, preferably beech. The fibers also vary in length from about 10 $\mu$m to about 50 $\mu$m,. with the preferred length of less than about 30 $\mu$m. The width of the fibers is about 18 $\mu$m.

Any polymeric binder may be used in the ink-retaining layer of the ink jet recording element employed in the invention. In general, good results have been obtained with gelatin, a polyurethane, a vinyl acetate-ethylene copolymer, an ethylene-vinyl chloride copolymer, a vinyl acetate-vinyl chloride-ethylene terpolymer, an acrylic polymer or a polyvinyl alcohol.

In another embodiment of the invention, the ink-retaining layer comprising voided cellulosic fibers may be overcoated with an ink-transporting layer commonly used in the art. In general, good results have been obtained when the ink-transporting layer contains materials such as alumina particles, silica particles or polymer beads, such as methyl methacrylate or styrene. This two-layer system provides more ink absorption capacity, faster dry times, and reduced cost compared to thicker single layers of organic or inorganic particles.

Any resin-coated paper support may be used in the invention, such as, for example, Kodak photo grade Edge Paper®, Kodak Royal® Paper and Kodak D'Lite® Paper.

If desired, in order to improve the adhesion of the fiber layer to the support, the surface of the support may be corona discharge-treated prior to coating.

The layers described above may be coated by conventional coating means onto a support material commonly used in this art. Coating methods may include, but are not limited to, wound wire rod coating, slot coating, slide hopper coating, gravure, curtain coating and the like.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following example further illustrates the invention.

EXAMPLE

Element 1 (Fibers, Single Layer) (Invention)

A solution of Arbocel® alpha beech 20 μm fibers and poly(vinyl alcohol) (PVA) at a weight ratio of 85/15 was prepared at 20% solids. This was coated using a metered rod at 100 μm wet laydown, on a corona discharged-treated, resin coated, photo grade paper, Kodak Edge® Paper, and oven dried at 150° F. for 30 minutes, to a dry thickness of 20 μm.

Control Element (Alumina, Single Layer) C-1

A solution of fumed alumina and PVA at a weight ratio of 90/10 was prepared at 20% solids. This was coated and dried similar to Element 1.

Element 2 (Fiber Layer and Alumina Layer) (Invention)

The solutions from Element 1 and C-1 were coated to form a two layer structure. The fiber solution from Element 1 was coated similar to Element 1 using a metered rod at 80 μm wet laydown to form the bottom layer at a dry thickness of about 15 μm. This layer was dried similar to Element 1. Then the alumina solution from C-1 was coated on top of the fiber layer using a metered rod at 80 μm wet laydown to form the top layer at a dry thickness of about 15 μm. This was dried similar to Element 1.

Control Element (Silica, Single Layer) C-2

A solution of silica particles and PVA at a weight ratio of 90/10 was prepared at 20% solids. This was coated and dried similar to Element 1.

Element 3 (Fiber Layer and Silica Layer) (Invention)

The solutions from Element 1 and C-2 were coated to form a two layer structure. The fiber solution from Element 1 was coated similar to Element 1 using a metered rod at 80 μm wet laydown to form the bottom layer at a dry thickness of about 15 μm. This layer was dried similar to Element 1. Then the silica solution from C-2 was coated on top of the fiber layer using a metered rod at 80 μm wet laydown to form the top layer at a dry thickness of about 15 μm. This was dried similar to Element 1.

Control Element (Polymer Beads, Single Layer) C-3

A solution of methyl methacrylate beads (Eastman Kodak Co.), about 160 nm and PVA at a weight ratio of 85/15 was prepared at 15% solids. This was coated and dried similar to Element 1 except that the metered rod at 130 μm wet laydown was used.

Element 4 (Fiber Layer and Polymer Beads) (Invention)

The solutions from Element 1 and C-3 were coated to form a two layer structure. The fiber solution from Element 1 was coated similar to Element 1 using a metered rod at 80 μm wet laydown to form the bottom layer at a dry thickness of about 15 μm. This layer was dried similar to Element 1. Then the polymer bead solution from C-3 was coated on top of the fiber layer using a metered rod at 130 μm wet laydown to form the top layer at a dry thickness of about 15 μm. This was dried similar to Element 1.

Testing

Each element was imaged on an Epson 740 printer using the inks S020189 (Black) and S020191 (Color). A test target was printed with each color (cyan, magenta, yellow, red, green, blue, black) in a long stripe the full length of the paper, taking approximately 6 minutes., As soon as the printing was finished, a sheet of bond copier paper (Hammermill Tidal DP®) was placed over the element and a roller weighing about 1.75 kilograms was rolled over it. The bond paper was pulled off immediately. The dry time was calculated using the distance down the color stripe where no ink transfer occurred and the printing time. The trailing end of the stripe had dried 0 minutes, while the leading edge of the stripe had dried for about 6 minutes. The dry time is taken to be at the point where no ink transfer occurred.

The optical density was read using an X-Rite® densitometer and was the average of all the colors (cyan, magenta, yellow, red, green, blue, black). The results are shown in the following Table:

TABLE

| Element | Optical Density | Dry Time (min) |
|---|---|---|
| 1 | 2.11 | 0.0 |
| C-1 | 1.57 | 5.0 |
| 2 | 2.04 | 0.0 |
| C-2 | 1.59 | 6.0 |
| 3 | 2.11 | 0.1 |
| C-3 | 1.68 | 5.5 |
| 4 | 1.97 | 0.15 |

The above results show that Element 1 of the invention had a higher optical density and much better drying time than C-1 using alumina, C-2 silica and C-3 using polymer beads. Elements 2-4 of the invention, a two-layer structure, also had higher optical density and much better drying time than the control elements.

This invention has been described with particular reference to preferred embodiments thereof but it will be understood that modifications can be made within the spirit and scope of the invention.

What is claimed is:

1. An ink jet recording element comprising a resin-coated paper support having thereon an ink-retaining layer comprising voided cellulosic fibers in a polymeric binder, the ratio of said voided cellulosic fibers to said polymeric binder being from about 90:10 to about 50:50, the length of said voided cellulosic fibers being from about 10 μm to about 50 μm, said cellulosic fibers being derived from beech pulp, maple pulp or pine pulp, said voided cellulosic fibers having an internal voided structure that enables them to act as micro-straws to assist in absorbing fluid.

2. The recording element of claim 1 wherein said cellulosic fibers are less than about 30 μm in length and have a width of about 18 μm.

3. The recording element of claim 1 wherein said polymeric binder comprises gelatin, a polyurethane, a vinyl acetate-ethylene copolymer, an ethylene-vinyl chloride copolymer, a vinyl acetate-vinyl chloride-ethylene terpolymer, an acrylic polymer or a polyvinyl alcohol.

4. The recording element of claim 1 wherein said ink-retaining layer is overcoated with an ink-transporting layer.

5. The recording element of claim 4 wherein said ink-transporting layer comprises alumina particles, silica particles or polymer beads.

* * * * *